United States Patent [19]

Smith

[11] 4,388,740

[45] Jun. 21, 1983

[54] FOAM RANDOM DYEING SYSTEM

[75] Inventor: Larry G. Smith, North Augusta, S.C.

[73] Assignee: United Merchants & Manufacturers, Inc., New York, N.Y.

[21] Appl. No.: 183,615

[22] Filed: Sep. 2, 1980

Related U.S. Application Data

[62] Division of Ser. No. 80,062, Sep. 28, 1979, Pat. No. 4,282,729.

[51] Int. Cl.[3] ..... D06B 1/00

[52] U.S. Cl. ..... 8/151; 8/158

[58] Field of Search ..... 68/200, 205 R; 118/323; 239/186, 223, 224; 8/477, 149, 151, 158

[56] References Cited

U.S. PATENT DOCUMENTS 1,022,956 4/1912 Lengerke et al. ..... 239/224 X 3,903,715 9/1975 Plotz ..... 68/205 R 3,969,780 7/1976 Henderson ..... 68/205 R X

*Primary Examiner*—Philip R. Coe

*Attorney, Agent, or Firm*—Kenyon & Kenyon

[57] ABSTRACT

A method for applying a foam composition containing a coloring agent randomly dispersed therein onto a textile fabric. The coloring agent is mixed into the foam in a non-homogeneous manner and deposited onto a fabric in a system having a depositing means which is rotated and moved transverse to the direction of travel of the fabric being treated so as to achieve substantially random motion with respect to the fabric. The foam-coloring agent composition is caused to flow axially and in one embodiment over the edges of a baffle means in a random manner onto the textile fabric being treated so as to impart a random application of the coloring agent thereon.

2 Claims, 8 Drawing Figures

Fig. 4.
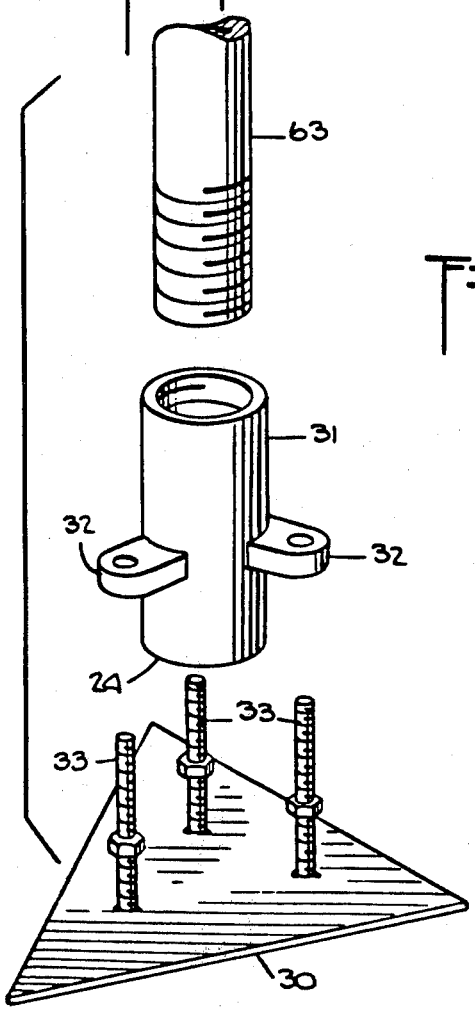
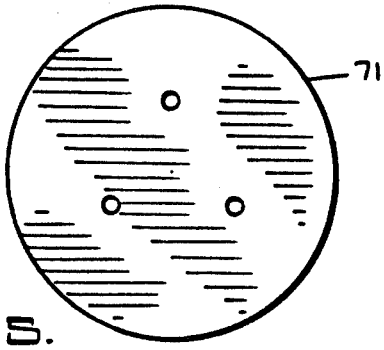
Fig. 5.
Fig. 6.
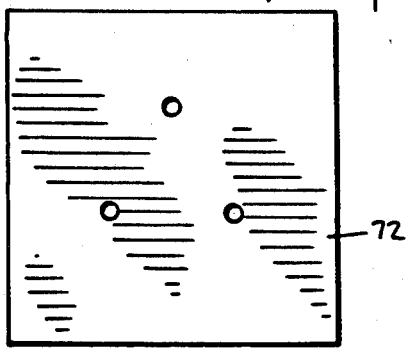
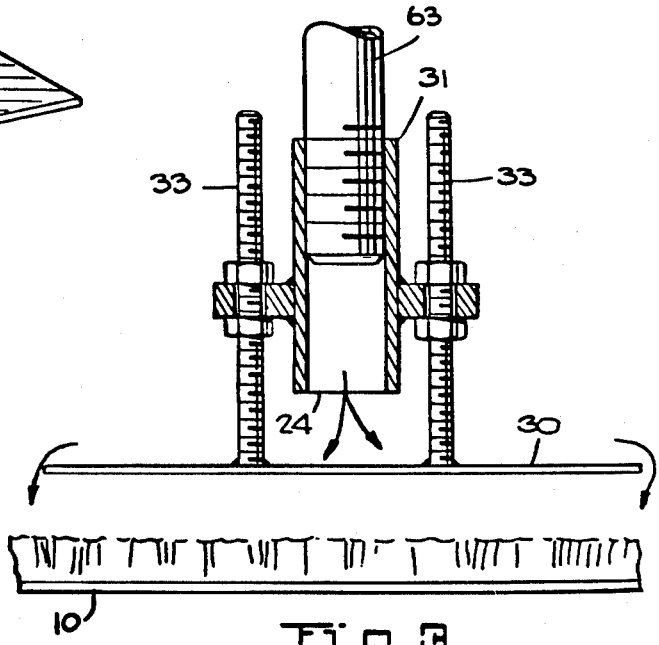
Fig. 8.
Fig. 7.
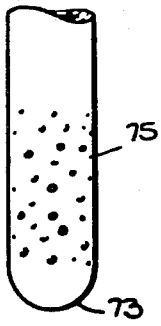
Fig. 8.
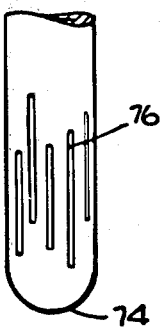

FOAM RANDOM DYEING SYSTEM

This is a division of application Ser. No. 80,062 filed Sept. 28, 1979, now U.S. Pat. No. 4,282,729.

BACKGROUND OF THE INVENTION

This invention relates generally to a method for applying coloring agents dispersed in a foam composition onto a textile fabric and more particularly to one wherein the foam-coloring agent composition is applied to the textile fabric in a random manner.

Usage of foam compositions in treating textile fabrics results in numerous advantages particularly with respect to energy conservation in that large quantities of water previously utilized in the prior art systems are not emloyed. One system describing the use of a foam composition is disclosed in U.S. Pat. No. 4,118,526 entitled "Method for Treating Fabrics". As is the case in certain conventional textile treating systems, it has been found highly desirable in certain instances to treat the fabric with a foam composition in a manner to produce a random design on the fabric. In this connection, certain aesthetic requirements frequently make it desirable to cause a generally non-repeating pattern to be imparted onto the fabric when it is being dyed such as the case with the application of a coloring agent.

In the instance where a fabric is treated with a foam composition including a coloring agent dispersed therein, it is first necessary to regulate the degree of dispersement of the coloring agent within the foam composition and subsequently to further apply the foam coloring agent composition onto the fabric in a generally random fashion. The prior art devices fail to provide such a system which applicant discloses herein and which overcomes the shortcomings of the prior art.

SUMMARY OF THE INVENTION

The invention herein disclosed, in general provides a method in which a textile fabric is passed through a foam application station in which a coloring agent in a foam composition is applied so as to create a random coloring effect on the textile fabric being treated. The inventive method creates the desired coloring effect by application of the composition in a random and generally non-repeating manner. The desired coloring effect may be applied to all types of textile fabrics or substrates including woven and non-woven fabrics, carpets, pile fabrics and the like. The coloring effect may be achieved by dyeing or application of any other type of process by which a coloring change is effected.

Thus, an apparatus is disclosed for applying a foam composition onto a textile fabric for the purpose of imparting a random coloring effect onto the fabric. A foam composition supply means is incorporated into the system which provides a foam composition into which a coloring agent is interspersed. A conduit is provided through which the foam and coloring agent are routed to an opening in the end of the conduit for application onto the textile fabric. Prior to application of the foam composition onto the textile fabric, means are provided in association with the downwardly directed exit portion of the conduit to direct the flow of the foam composition, at least partially, in a direction axial and parallel to the surface of the fabric being treated so that the foam coloring agent composition is distributed randomly onto the fabric being treated.

In a specific embodiment, a nozzle is employed and connected to the exit portion of the conduit. The lowermost portion of the nozzle is closed and includes a plurality of spaced apertures along the nozzle side wall. The apertures may be in the form of slits or other shapes. The flow of the foam, color-containing composition is thereby caused to be directed axially through the nozzle apertures and onto the fabric being treated.

In another embodiment, a baffle means is spaced from the conduit opening and interposed between the opening and fabric being treated. In this manner, the foam-coloring agent composition exiting from the opening is distributed onto the fabric being treated in a generally random pattern. The baffle means is in the form of a plate member having a predetermined configuration and which is disposed with one surface thereof spaced from the conduit opening and being of a size such that the foam composition and coloring agent exiting therefrom flow in an axial direction over the edges of the baffle and onto the surface of the textile fabric being treated. The system further includes a means for moving the conduit in a direction transverse to that of the travel of the fabric being treated. Further, means are included in the system for rotating or otherwise moving the baffle means relative to the stationary portion of the conduit. Alternatively, the baffle movement means may be directly connected thereto so as to facilitate movement of the baffle means with respect to the conduit opening.

In a more specific embodiment of the invention, the baffle means is provided in the form of a substantially flat plate member having its planar surface disposed in a generally horizontal plane and spaced from the conduit opening. Other shapes and configurations may also be utilized. A drive means is associated with the baffle moving means so as to impart a rotary or oscillating motion to the baffle means. The drive means operates in conjunction with a rotary coupling connected upstream of the conduit opening to permit relative movement of the opening with respect to the remainder of the conduit such that a rotary or oscillating movement is imparted to the opening and the baffle means attached thereto. The baffle means is mounted adjacent the conduit opening by means of a coupling member and further includes an adjustment such that the spacing between the baffle and conduit opening may be regulated in accordance with the desired coloring effect to be imparted onto the fabric being treated.

In a specific embodiment of the invention, the foam is provided from a foam supply while the coloring agent is supplied from a similar coloring agent supply means. Means for mixing the coloring agent and foam composition are included and spaced from the conduit opening a predetermined distance. The spacing distance is regulated in accordance with the degree of mixing desired between the coloring agent and foam composition. In order to achieve a random coloring effect, a non-homogeneous mixture is desired. Thus, the mixing means is spaced relatively close to the conduit opening means so as to permit only a limited degree of mixing of the foam composition and coloring agent prior to application onto the fabric.

The method of the invention involves the application of a foam color containing composition onto a moving textile fabric which is being routed through a foam application station. The foam composition is mixed with a coloring agent to intersperse the coloring agent into the foam composition to a limited degree so as to create a non-homogeneous mixture. The foam-coloring agent composition delivery means is moved in a directed transverse to the direction of movement of the textile fabric while the composition is deposited onto the fabric. The method includes a further step of moving the foam composition and coloring agent in a second direction such as to deposit the foam and interspersed coloring agent onto the textile fabric being dyed in a random pattern.

The method of the invention in a specific embodiment includes the further step of moving the foam coloring agent delivery means in a rotary or oscillating manner. Depositing of the foam having the coloring agent interspersed therein is accomplished by flowing the composition at least to some degree in an axial direction such as for instance by flowing the composition onto a baffle means interposed between the delivery means and the fabric being treated. The baffle means is moved in a rotary or oscillating manner with the foam flowing over the edges of the baffle and onto the fabric being treated such as to impart a random coloring effect thereon.

Accordingly, it is an object of this invention to provide a method for applying a foam composition including a coloring agent therein onto a fabric being treated in a generally random type pattern.

It is another object of this invention to provide a method for delivering a foam composition suitable for dyeing a textile fabric with a random and generally non-repeating flow of the composition being applied onto the fabric.

It is another object of this invention to apply a foam composition containing a coloring agent therein onto a moving textile fabric by causing the direction of flow of the foam-color containing composition to be, at least to some degree, parallel to the surface of the fabric being treated prior to application thereon.

These and other objects, advantages and features of the invention will become more apparent from the following description taken in conjunction with the accompanying drawings.

BRIEF DESCRIPTION OF THE DRAWINGS

FIG. 3 is an enlarged cross-sectional view of the foam applicating system of this invention;

FIG. 4 is an exploded view illustrating the various components of the foam applicating system of this invention;

FIG. 5 is a plan view of an alternate embodiment of the baffle means associated with the foam applicator of this invention;

FIG. 6 is another embodiment of the baffle means associated with the foam applicator;

FIG. 7 is a partial elevation view of an alternate embodiment of the foam application nozzle; and FIG. 8 is another embodiment of an alternative foam application nozzle.

DESCRIPTION OF THE PREFERRED EMBODIMENT

Figure 1:
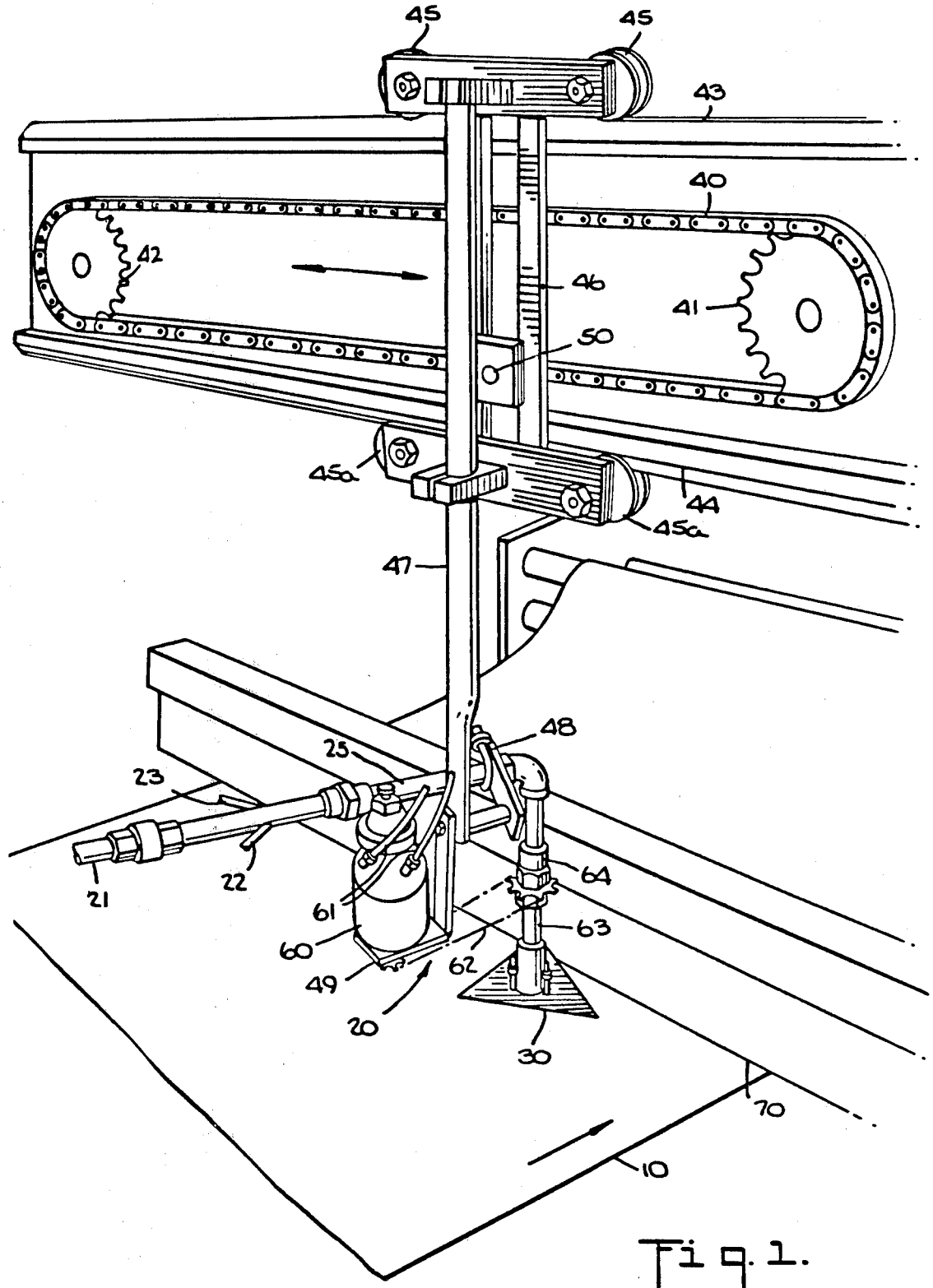
FIG. 1 is a perspective view of the foam applying means of this invention and the drive system associated therewith.

With reference to the drawings and particularly FIG. 1, the textile fabric 10 being treated is moved in the direction of the arrow through a foam application station 20. A conduit 21 is connected at the upstream end to a foam supply means (not shown). Coloring agent or agents are interspersed into the foam composition via the inlet pipes 22 and 23. It is noted that different coloring agents may be introduced via each of the inlet pipes and that additional pipes may be employed as necessary to achieve the desired effect. An even greater dispersion of the coloring agent into the foam composition may be achieved by changing the orientation of the inlet pipes 22 and 23 to cause the coloring agent to be injected into the foam while flowing in a direction opposite thereto. The foam composition and coloring agent are mixed to a certain degree in a static mixer 25 which is a conventional type used in the art. The positioning of the static mixer 25 is sufficiently close to the conduit outlet 24 so that a non-homogeneous dispersion of the coloring agent into the foam composition is accomplished. The degree of mixing is also controlled by proper selection of the number of elements (not shown) incorporated in the static mixer.

Figure 2:
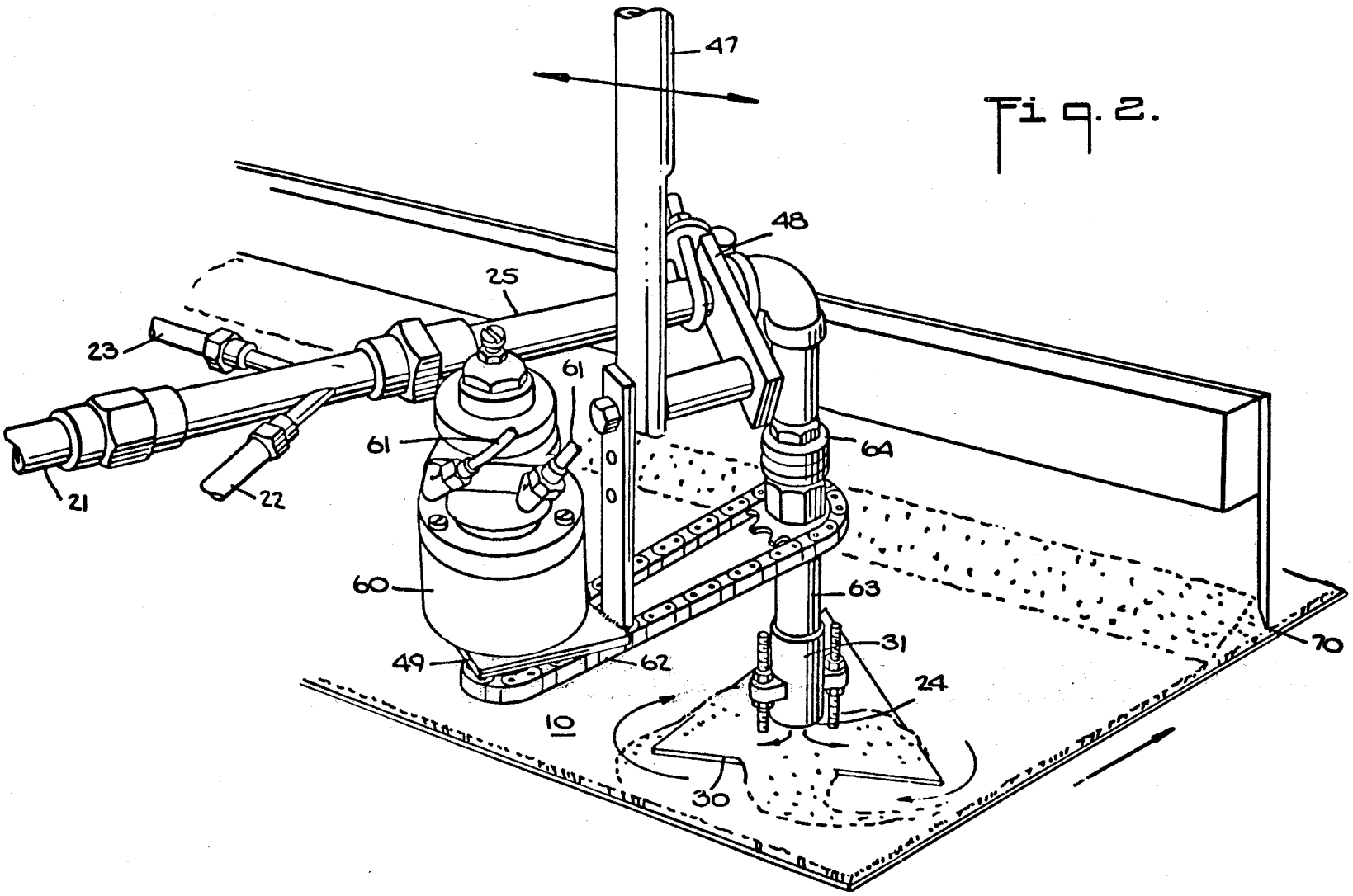
FIG. 2 is an enlarged perspective view of the foam applying means of FIG. 1 illustrating the depositing of the foam onto a moving textile fabric.

As shown in FIGS. 2–4, a baffle means or plate 30 is mounted to the downwardly directed portion of the conduit 21 by means of a coupling 31 with the open end thereof thus forming the foam-coloring agent composition exit means 24. Coupling 31 is screwed onto the end of the conduit and is provided with ears 32 which serve to adjustably mount the baffle plate 30. In this connection, screw members 33 are positioned on the inner side of the baffle plate 30 and fastened into the coupling ears 32 with the spacing of the baffle plate from the opening 24 thus being adjustable.

The entire conduit assembly is movable transverse to the direction of movement of the textile fabric 10 being treated. A chain drive member 40 is mounted over sprocket members 41 and 42, the latter of which is coupled to a main drive motor. Horizontally disposed rail member 43 supports and guides an upper set of wheels 45. A frame assembly 46 is formed with the upper set of wheels 45 being thereby joined to a lower set of guide wheels **45*a* which in turn are guided by a lower rail member 44. A vertical support bar 47 is fixed to the frame assembly 46 at its upper end and at the lower end supports the foam carrying conduit 21 by means of the support bracket 48 attached thereto. Also attached to the lower portion of bar 47, is an L-shaped support member 49 onto which is mounted an air drive motor 60**.

In this manner, as the main drive means is activated, frame 46 being fixed to the chain 40 at 50 thus moves in association therewith thereby moving the foam carrying conduit 21 from one edge of the textile being treated to the other edge thereof. Air drive motor 60, mounted on support 49, is driven through couplings 61 which in turn are in communication with an air supply means (not shown). A chain and sprocket drive 62 is connected to the lower portion of the conduit 63 adjacent a rotary coupling 64 so as to facilitate movement of the lower portion of the conduit 63 independent of the remainder of the conduit 21. Thus, the air drive motor 60 is connected to drive the conduit opening 24 and baffle plate 30 either in a rotary or oscillating fashion as desired and independent of the transverse drive means. If desired, drive motor 60 may be directly connected to baffle plate 30 so as to move the latter with respect to opening 24. It is noted that both the transverse drive means and rotary drive means are preferably variable. Although the illustrated embodiment includes a single opening 24, it is also noted that multiple openings or heads may be provided.

A foam-coloring agent composition is thus routed through conduit 21 to the opening 24 and onto the baffle plate 30. The foam is caused to generally flow over the peripheral edges of the baffle plate 30 and onto the fabric 10. A doctor blade 70 is utilized to regulate the level of foam thus applied onto the fabric. Because of the transversing motion and the rotating motion of the baffle plate 30, each movement being independent of the other, as well as the manner in which the foam is caused to flow over the peripheral edges of the baffle plate, it has been found that a generally random non-repetitive pattern is applied to the fabric under treatment. Further effects may be created by oscillating the movement of the baffle plate 30 as well as by variably regulating the flow of the foam-color containing composition. Further effects may be achieved by utilizing different configurations for the geometric shape of the baffle plate. For instance, as illustrated in FIG. 5, a circular baffle plate 71 may be utilized or as illustrated in FIG. 6 a square baffle plate 72 may also be employed. Of course, other geometric shapes may similarly be utilized as well as curved or other nonflat surfaces. If is futher noted that openings of various configurations may be incorporated in the baffle plate 30.

In FIGS. 7 and 8, alternate embodiments of the conduit outlet are illustrated in the form of nozzles 73 and 74 which may be utilized independently of a baffle plate 30. Nozzle 73 is closed at the lower end thereof and provided with a plurality of openings 75 which are preferably between $\frac{1}{8}''$ and $\frac{1}{4}''$ diameter in size and which may be either uniformly or randomly spaced from one another. In the embodiment of FIG. 8, slits 76 are provided in a staggered configuration. The slits are preferably of a width between 1/32" and $\frac{1}{8}''$. In each embodiment, it is preferred that the openings 75 or slits 76 do not extend into the lower or closed portion of the nozzle. In this manner, the flow of the foam-color containing composition is caused to change direction and move axially with respect to the conduit. Thus, the foam-color containing composition is caused to flow prior to application in a direction, at least to some degree, parallel to the surface of the fabric being treated. Thus, the direction of flow of foam-color containing composition has a horizontal component, as distinct from a downwardly directed application, which in association with the other directions of movement imparted in the system achieve a random and generally non-repeating coloring effect on the fabric being treated. Other effects and degrees of randomness can be achieved by bending the nozzle tip to various angles including a 90° bend in order to produce varying degrees of scallops or spirals with the length of the bent tip thus controlling the radius of the scallops or spirals.

In practicing the method of the invention, the foam composition is provided to the conduit 21 and interspersed with a coloring agent or agents via lines 22 and 23. As mentioned, the degree of mixing is controlled both by the number of elements in the static mixer 25 and the distance thereof from the exit opening 24. The foam exiting from opening 24 is caused to flow, at least to some degree, in an axial direction and in one embodiment, onto the baffle plate 30 which is being moved both transverse to the direction of the travel of the textile material being treated as well as being rotated or oscillated. The foam-color containing composition thus flows to a degree axially and parallel to textile fabric 10 in a manner which is random both because of the motions imparted to the delivery means as well as the manner in which the composition exits therefrom. Further, a baffle may be employed and the flow of the foam-color containing composition over the edges of the baffle plate may be regulated by adjusting the distances between the plate 30 and the opening 24 by means of adjustment screws 33.

Thus there has been described an improved method and apparatus for creating a coloring effect on a textile fabric by utilization of a foam composition, the characteristics of which are both generally random and non-repetitive.

Although the above description is directed to a preferred embodiment of the invention, it is noted that other variations and modifications will be apparent to those skilled in the art and, therefore, may be made without departing from the spirit and scope of the present disclosure.

What is claimed is:

1. A method of foam dyeing a textile fabric to impart a generally random coloring effect thereto, the method comprising the steps of:

moving the fabric to be treated along a substantially horizontal path through a foam application station;

mixing a foam composition and coloring agent into a non-homogeneous mixture having said coloring agent dispersed therein;

conducting said non-homogeneous mixture to a mixture delivery means disposed above and spaced from the substantially horizontal fabric being treated;

moving said mixture delivery means in a direction transverse to the horizontal direction of movement of the textile fabric and feeding downwardly said non-homogeneous mixture onto the textile fabric from said mixture delivery means;

directing the flow of said non-homogeneous mixture, at least partially, in a direction substantially parallel to the surface of the horizontally disposed textile fabric being treated prior to depositing said non-homogeneous mixture onto the textile fabric; and further moving said mixture delivery means in a generally rotary direction so as to deposit said non-homogeneous mixture onto the textile fabric in a substantially random pattern thereby imparting the generally random coloring effect thereon.

2. A method in accordance with claim 1 comprising the further steps of:

depositing said non-homogeneous mixture onto a baffle means having at least one edge, and which is interposed between said delivery means and the textile fabric;

moving said baffle means in a substantially rotary manner; and flowing said non-homogeneous mixture over said edge of said baffle means and onto the textile fabric to impart the generally random coloring effect thereon.

* * * * *